US012281546B2

(12) United States Patent
Dhuet et al.

(10) Patent No.: US 12,281,546 B2
(45) Date of Patent: Apr. 22, 2025

(54) DOWNHOLE TOOL, METHOD AND SYSTEM

(71) Applicant: Baker Hughes Oilfield Operations LLC, Houston, TX (US)

(72) Inventors: Herb Dhuet, Richmond, TX (US); Daniel J. Turick, Houston, TX (US); Richard Ochoa, Pasadena, TX (US); Jason Fuxa, Houston, TX (US); Wilfred Provost, Tomball, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 44 days.

(21) Appl. No.: 17/965,385

(22) Filed: Oct. 13, 2022

(65) Prior Publication Data

US 2024/0125212 A1 Apr. 18, 2024

(51) Int. Cl.

| | |
|---|---|
| ***E21B 43/04*** | (2006.01) |
| ***E21B 23/04*** | (2006.01) |
| ***E21B 34/06*** | (2006.01) |
| ***E21B 34/14*** | (2006.01) |

(52) U.S. Cl.

CPC ..... *E21B 43/045* (2013.01); *E21B 23/0412* (2020.05); *E21B 34/066* (2013.01); *E21B 34/14* (2013.01); *E21B 2200/06* (2020.05)

(58) Field of Classification Search

CPC ..... E21B 34/066; E21B 37/08

See application file for complete search history.

(56) References Cited

U.S. PATENT DOCUMENTS

| | | | |
|---|---|---|---|
| 6,378,609 | B1 * | 4/2002 | Oneal et al. |
| 2012/0012312 | A1 | 1/2012 | Whitsitt et al. |
| 2014/0190704 | A1 | 7/2014 | Kucera et al. |
| 2017/0138158 | A1 | 5/2017 | Bourgneuf et al. |
| 2018/0252073 | A1 * | 9/2018 | Richard et al. |
| 2019/0301267 | A1 * | 4/2019 | Segura et al. |
| 2021/0047899 | A1 * | 2/2021 | Docherty et al. |

FOREIGN PATENT DOCUMENTS

| | | | |
|---|---|---|---|
| EP | 1041241 | A2 | 10/2000 |

OTHER PUBLICATIONS

Notification of Transmittal of the International Search Report and the Written Opinion of the International Searching Authority, or the Declaration; PCT/ 2023/076176; Mail date: Feb. 6, 2024; 10 pages.

* cited by examiner

*Primary Examiner* — Tara Schimpf
*Assistant Examiner* — Ursula Lee Norris
(74) *Attorney, Agent, or Firm* — Baker Hughes Patent Organization

(57) ABSTRACT

A downhole tool including a gravel pack assembly, a remotely addressable actuator connected to the gravel pack assembly, and a valve responsive to the actuator, the valve opening and closing a washdown path through the tool. A method for gravel packing a borehole including running a tool to a target depth in the borehole, flowing washdown fluid through the tool, sending an electric signal to the actuator to close the valve, and flowing through a cross over port of the gravel pack assembly. A borehole system including a borehole in a subsurface formation, a tool disposed within the borehole.

18 Claims, 18 Drawing Sheets

DOWNHOLE TOOL, METHOD AND SYSTEM

BACKGROUND

In the resource recovery and fluid sequestration industries there are often times when a tool is required to have one mode where fluid passes therethrough and another mode where fluid passage is prevented in order to increase pressure upstream of the tool or to divert fluid flow to outside of the tool. Traditionally, duties of this sort have been carried out by tools that employ dropped objects that are configured to land on a seat of the tool to shut off flow through the seat. While tools employing such drop objects are widely used in the industries identified there is an efficiency cost in waiting for the object to traverse the borehole and a risk that the object may become stuck prior to reaching the seat and therefore fail in its purpose. Since efficiency and reliability are always paramount in any downhole industry, the art always appreciated apparatus and methods that improve the same.

SUMMARY

An embodiment of a downhole tool including a gravel pack assembly, a remotely addressable actuator connected to the gravel pack assembly, and a valve responsive to the actuator, the valve opening and closing a washdown path through the tool.

An embodiment of a method for gravel packing a borehole including running a tool to a target depth in the borehole, flowing washdown fluid through the tool, sending an electric signal to the actuator to close the valve, and flowing through a cross over port of the gravel pack assembly.

An embodiment of a borehole system including a borehole in a subsurface formation, a tool disposed within the borehole.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
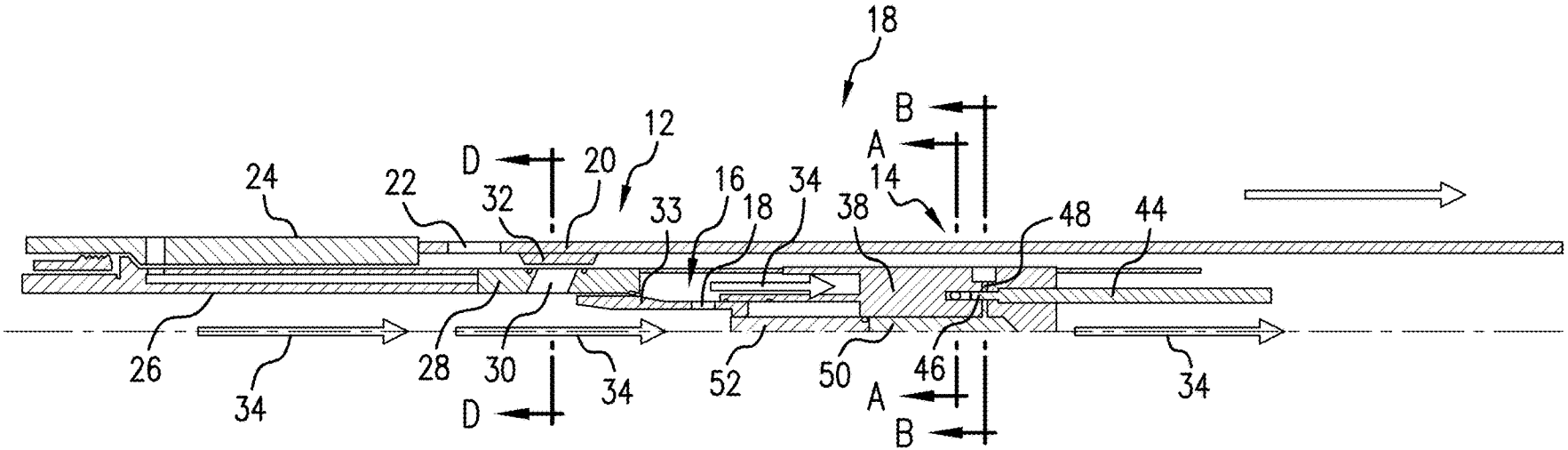
FIG. 1 is a cross sectional view of a downhole tool as disclosed herein.
Figure 1A:
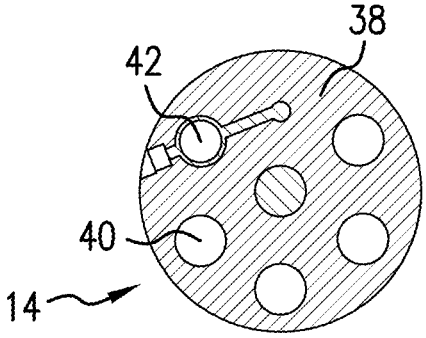
FIGS. 1A and 1B are cross section views of FIG. 1 taken along the respective section lines.
Figure 1B:
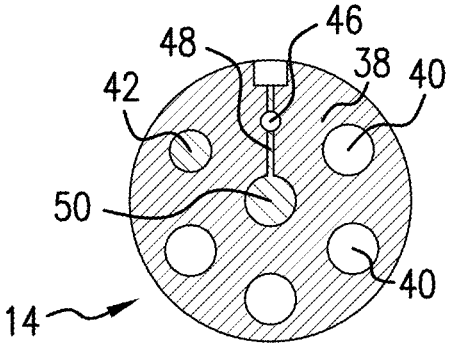
Figure 1C:
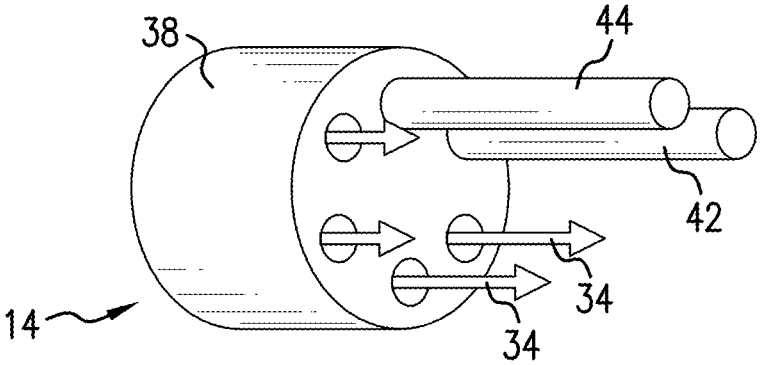
FIG. 1C is a perspective view of a portion of an actuator as disclosed herein to illustrate fluid flow pathways therethrough.

Referring to FIG. 1, a first embodiment of a downhole tool 10 disclosed herein is illustrated. Tool 10 comprises a gravel pack assembly 12 that is operably connected to a remotely addressable actuator 14 and a valve 16 responsive to the actuator 14. The valve 16 depending upon position either opens or closes a valve port 18. The valve port 18 is disposed within a washdown flow path (flow from an uphole end of tool 10, through tool 10, and back to the inside diameter of a bottom hole assembly that is attached to the downhole end of the tool 10) through the tool 10 such that if the valve port 18 is open, washdown operations are permitted while when the valve port 18 is closed, washdown operations are prevented. When the washdown operations are prevented by a closed valve port 18, it is possible to increase pressure upstream of the valve port 18 or divert fluid upstream of the valve port 18 or both.

The gravel pack assembly 12 comprises a housing 20 having an extension port 22 therethrough. A sealing element 24 is disposed about the housing 20 and configured to seal between the housing 20 and a radially outwardly positioned different structure upon setting. The element 24 may be set by mechanical compression, hydrophilic or oleophilic swelling, inflation, shape memory, etc. The tool 10 further includes a sleeve 26 disposed in a movable manner, within the housing 20. In an embodiment, the sleeve 26 moves longitudinally along the housing 20. The sleeve 26 includes a cross over port body 28 having a cross over port 30 therein that is alignable with the extension port 22 for fluid connectivity between port 22 and port 30 or misalignable to retard fluid communication between port 22 and port 30. In some embodiments, the housing 20 may also include a seal bore 32 disposed therein and with which the crossover port body 28 may seal to close the cross over port 30. When the port 22 and the port 30 are aligned, fluid flowing in the inside of sleeve 26 may be diverted to the outside of housing 20. This is the case when gravel is being crossed over for deposition outside of the housing in a gravel pack operation, for example.

Figure 2:
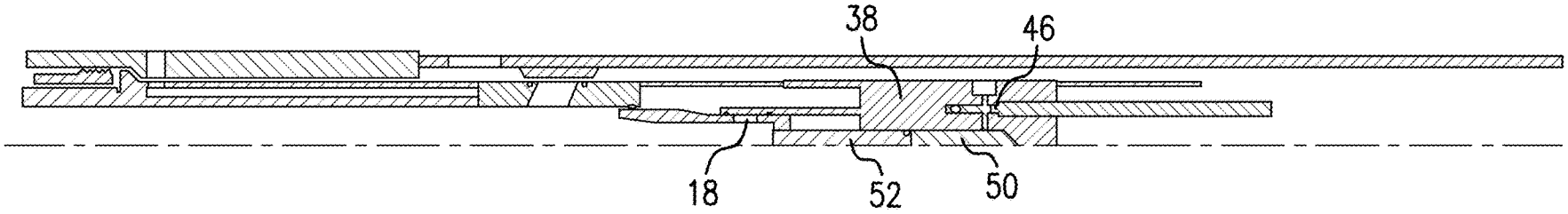
FIG. 2 is the embodiment of FIG. 1 in a second position.
Figure 2A:
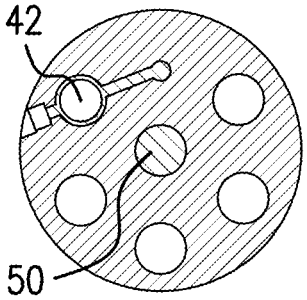
FIGS. 2A-2C are similar views to FIG. 1A-1C with the respective changes in position illustrated.
Figure 2B:
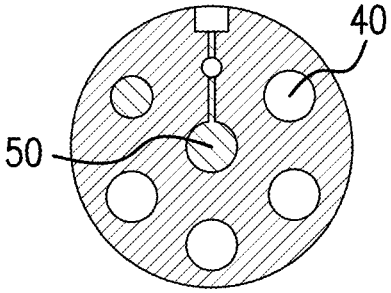
Figure 2C:
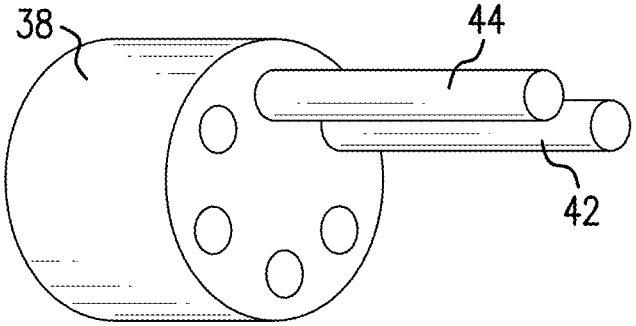

The actuator 14 and valve 16 are both disposed within the housing 20. Valve 16 includes a valve sleeve 33 that includes the valve port 18. The port 18 as noted above is disposed within the washdown flow path through tool 10. The path for the embodiment of FIG. 1 is illustrated by arrows 34 in FIG. 1. Valve sleeve 33 is movable longitudinally of the housing 20 based upon the reception by the actuator 14 of a signal. The signal could be electrical, acoustic, hydraulic, seismic, etc. Actuator 14 includes a body 38 having a plurality of holes 40 therethrough. An atmospheric chamber 42 is disposed in one of the holes 40 and an electronic controller 44 is disposed in another of the holes. The electronic controller responds to the signal to move a pin 46 out of a manifold 48 so that a hydraulic fluid chamber 50 becomes fluidly communicated with the atmospheric chamber 42. Once this fluidic connection is made, the lower pressure atmospheric chamber 42 will draw ambient pressured hydraulic fluid from chamber 50 into the chamber 42, thereby reducing volume of hydraulic fluid in the chamber 50. The reduction in volume in the chamber 50 causes a valve sleeve mover 52 to move into the chamber 50 thereby moving valve sleeve 33. This results in the position of tool 10 illustrated in FIG. 2. In the FIG. 2 position, washdown is halted at the sleeve 33 and pressure may be applied to increase pressure upstream of the sleeve 33. After conclusion of a pressure operation, the port body 28 is shifted to align the cross over port 20 with the extension port 22, whereafter fluid flowing through tool 10 may be diverted outside of housing 20.

Figure 3:
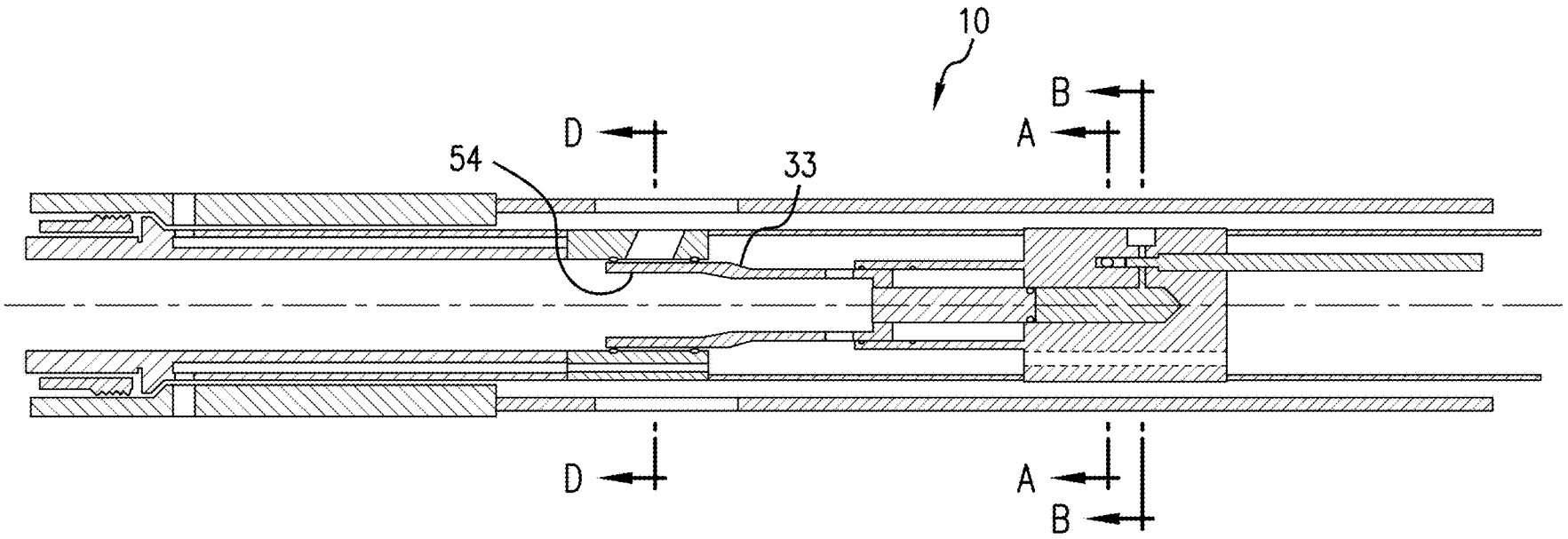
FIG. 3 is a cross sectional view of another embodiment of the tool disclosed herein in a first position.
Figure 3A:
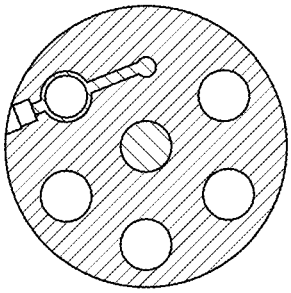
FIGS. 3A-3C are similar to those of FIGS. 1A-1C and 2A-2C.
Figure 3B:
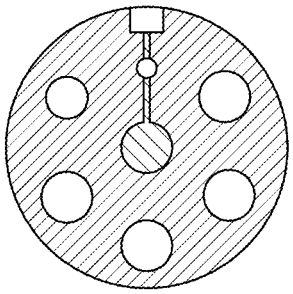
Figure 3C:
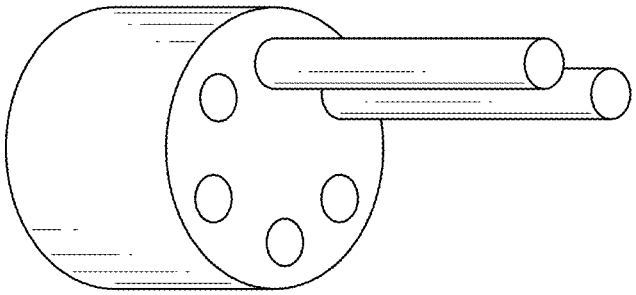
Figure 3D:
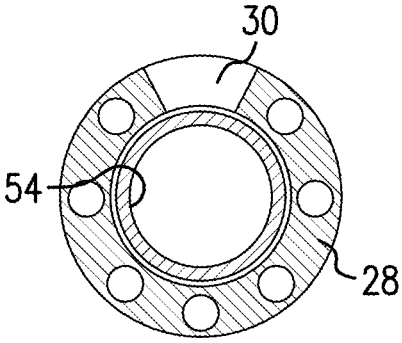
FIG. 3D is a cross sectional view taken along section line D-D in FIG. 3.
Figure 4:
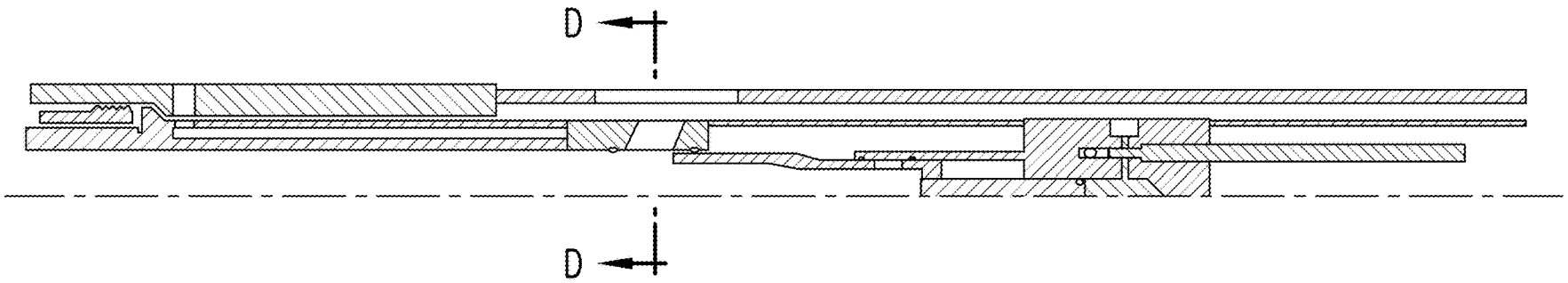
FIG. 4 is a cross section view of the embodiment illustrated in FIG. 3 but in a second position.
Figure 4A:
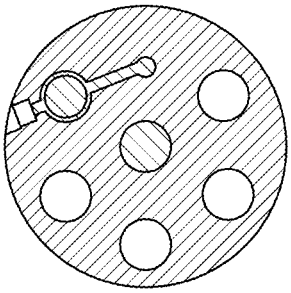
FIGS. 4A-4C are the same as FIGS. 3A-3C but in a different position.
Figure 4B:
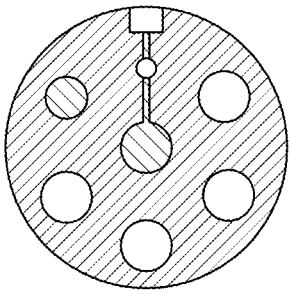
Figure 4C:
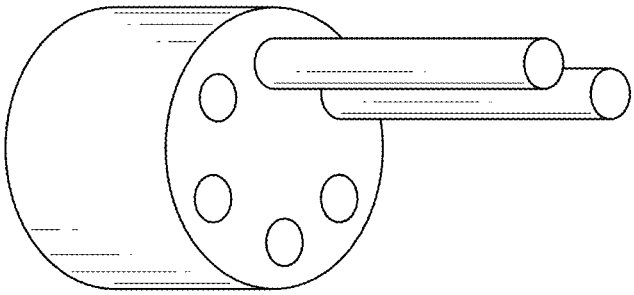
Figure 4D:
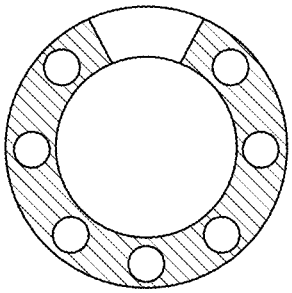
FIG. 4D is a cross section of FIG. 4 taken along section line D-D.

Referring to FIGS. 3-4C, an alternate embodiment of tool 10 is illustrated. In this embodiment the valve sleeve 33 includes a valve sleeve extension 54 that interacts with the cross over port body 28 to seal off the cross over port 30. In this embodiment, the seal bore 32 of the embodiment of FIG. 1 is not needed. It could however be retained if desired. In other respects, the embodiment of FIGS. 3-4C are similar to the embodiment of FIGS. 1 and 2.

Figure 5:
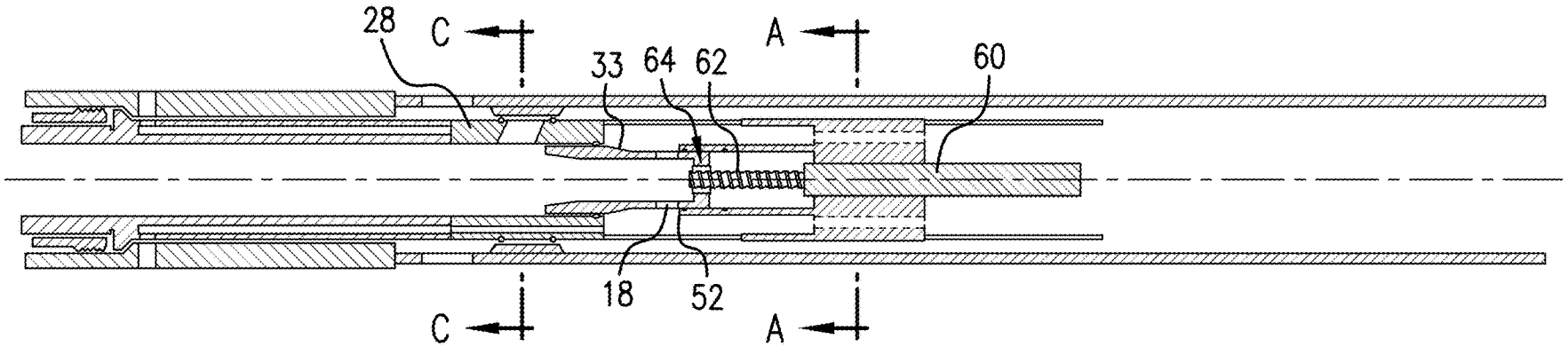
FIG. 5 is a cross section view of another embodiment of the tool disclosed herein.
Figure 5A:
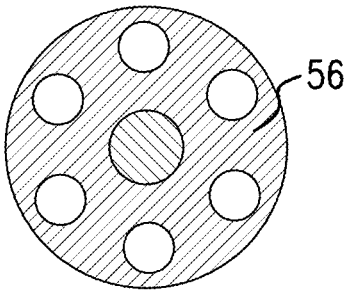
FIG. 5A is a cross section view of FIG. 5 taken along section line A-A.
Figure 5B:
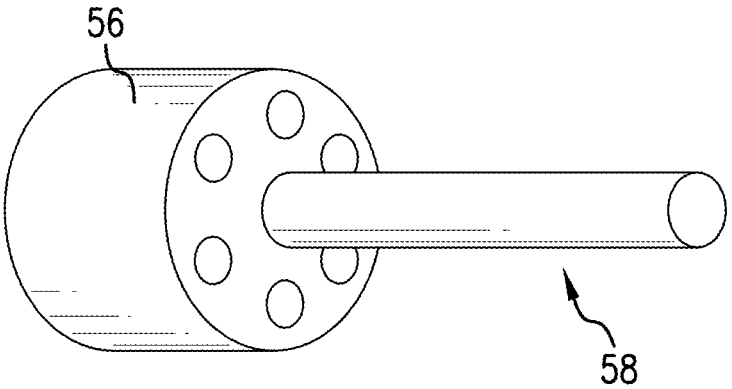
FIG. 5B is a perspective view of a portion of an actuator of the embodiment of FIG. 5.
Figure 5C:
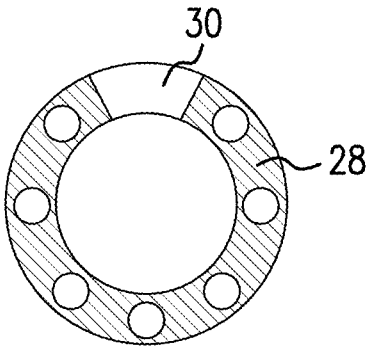
FIG. 5C is a cross section view of FIG. 5 taken along section line C-C.
Figure 6:
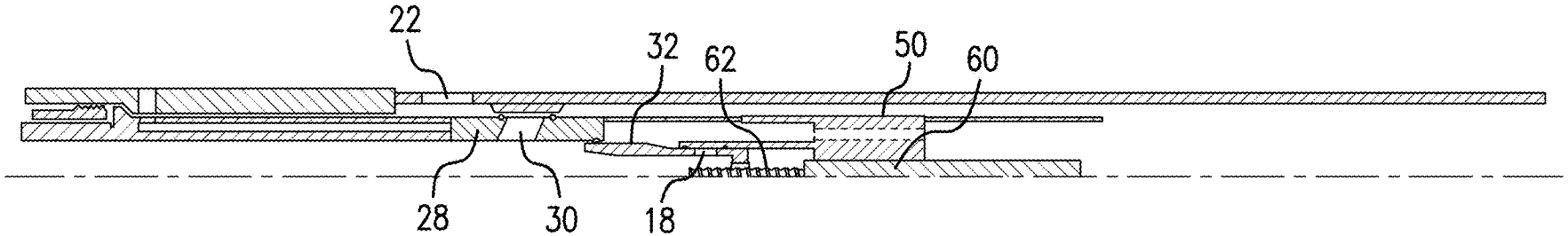
FIG. 6 is the embodiment of FIG. 5 in a second position.

Referring to FIGS. 5-6, another alternate embodiment is illustrated. In this embodiment, the gravel pack assembly 12 and the valve 16 are the same as FIG. 1 but the actuator 14 is distinct. Actuator 14 in this embodiment employs a body 56 that is similar to FIG. 1 but the electronic controller 58 in this embodiment is quite different. The controller 58 still receives a remote signal in the same possible ways described for FIG. 1 but it imparts motive force to the valve 16 via a motor 60 and a screw 62, which may be a lead or jack screw, or may be a ball screw or similar. Screw 62 interacts with a nut 64 that is a part of or connected to the sleeve mover 52. Rotation of the screw 62 then controls position of the valve sleeve 33 and hence whether the washdown path is open at port 18 or closed at port 18 (see FIG. 6).

As in FIG. 1, the embodiment of FIG. 5 can be used for pressure operations in the position of FIG. 6 or diversion operations in the position of FIG. 6 moving the cross over port body 28 to align port 30 with port 22.

Figure 7:
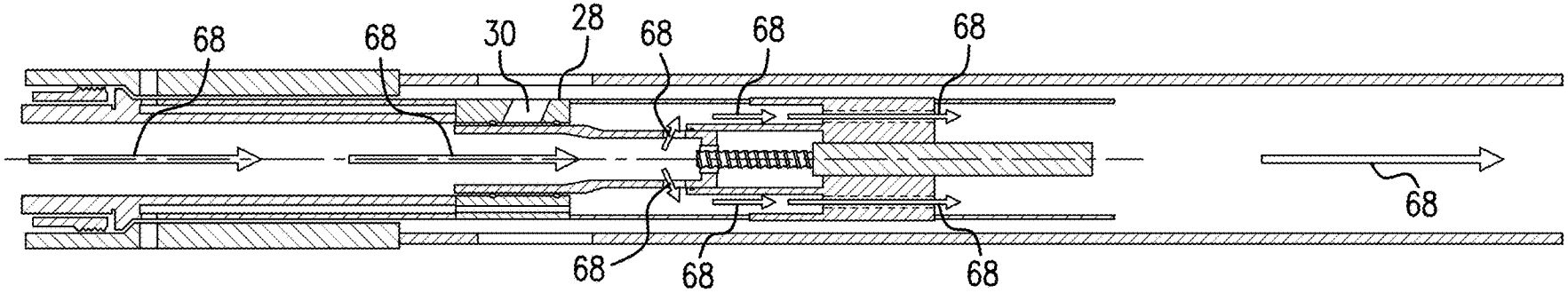
FIG. 7 is a cross section view of another alternate embodiment of tool disclosed herein.
Figure 8:
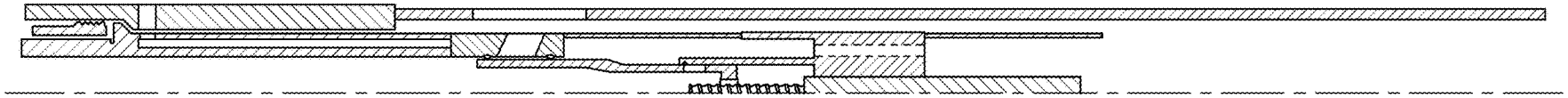
FIG. 8 is the embodiment of FIG. 7 in a second position.
Figure 9:
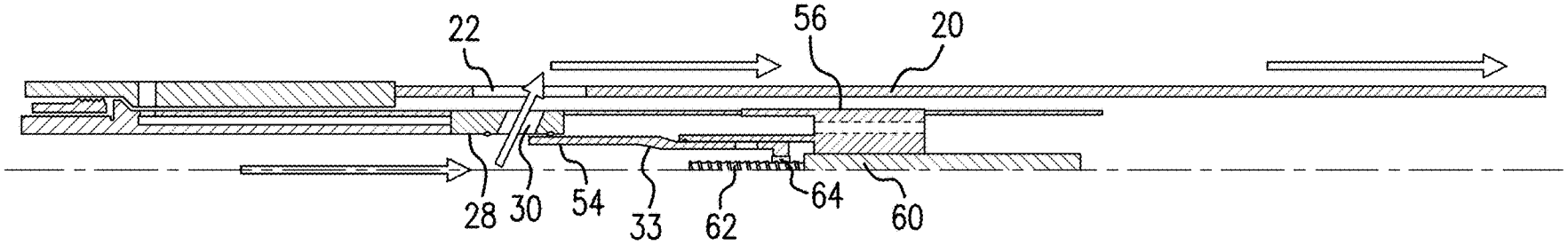
FIG. 9 is the embodiment of FIG. 7 in a third position.

Referring to FIGS. 7-9, an embodiment that combines elements from FIGS. 3 and 5 is illustrated. The actuator 14 is that of FIG. 5 while the valve sleeve 33 includes the extension 54 of FIG. 3. Functionality is as would be expected following exposure to the FIG. 3 and FIG. 5 embodiments. FIG. 7 also illustrates a washdown flow path with arrows 68. FIG. 8 illustrates the embodiment of FIG. 7 with the port 18 closed to prevent washdown flow but the port 30 still occluded by extension 54, and FIG. 9 illustrates the extension 54 displaced relative to the cross over port body 28 exposing port 30 so that fluid may flow through port 30 and port 22 for cross over operations.

Figure 10:
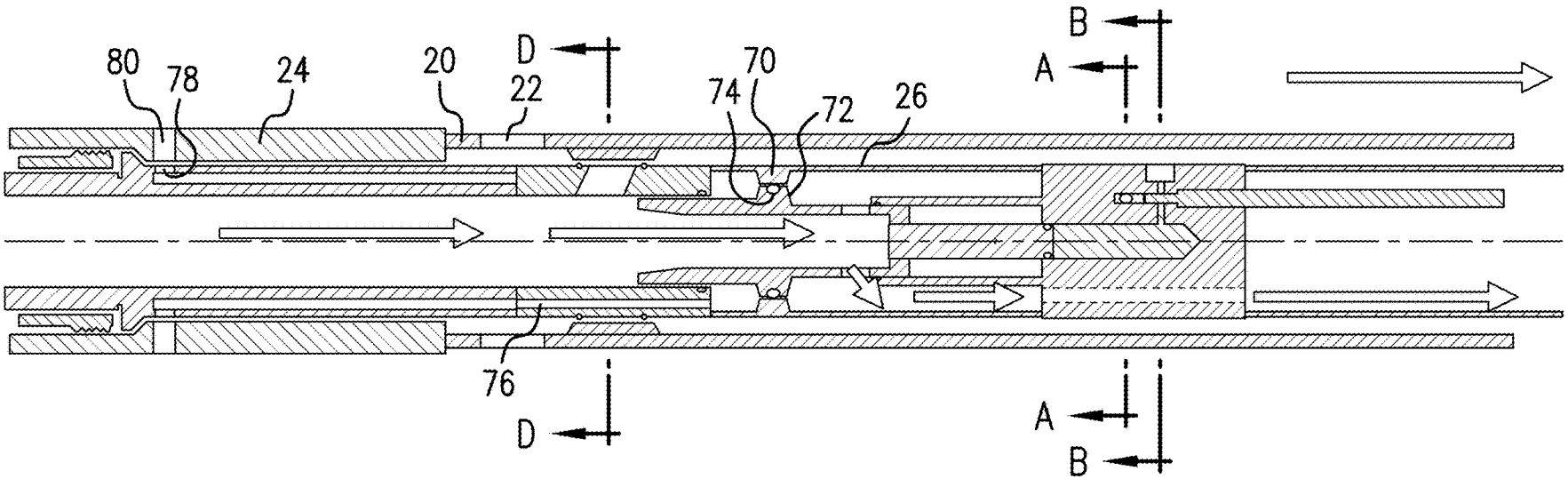
FIG. 10 is another embodiment of a tool disclosed herein.
Figure 10A:
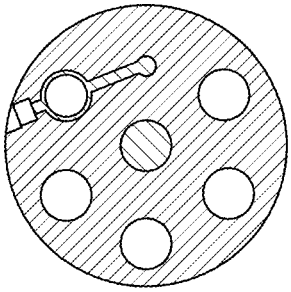
FIGS. 10A and 10B are cross section views of FIG. 1 taken along the respective section lines.
Figure 10B:
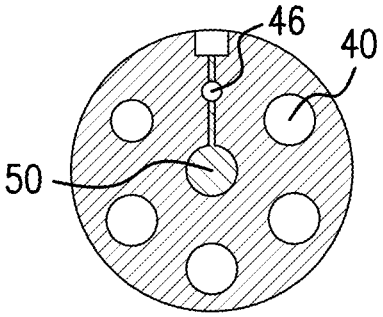
Figure 10C:
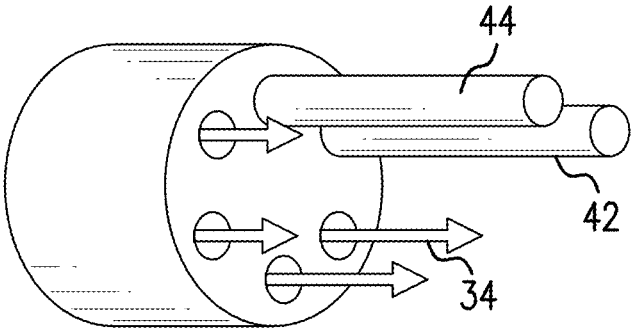
FIG. 10C is a perspective view of a portion of an actuator as disclosed herein to illustrate fluid flow pathways therethrough.
Figure 10D:
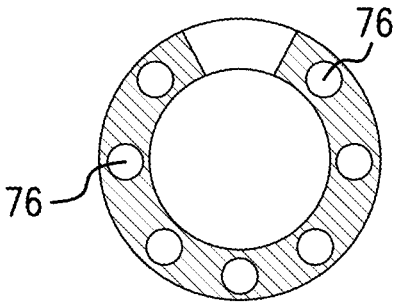
FIG. 10D is a cross section view taken along section line D-D in FIG. 10.
Figure 11:
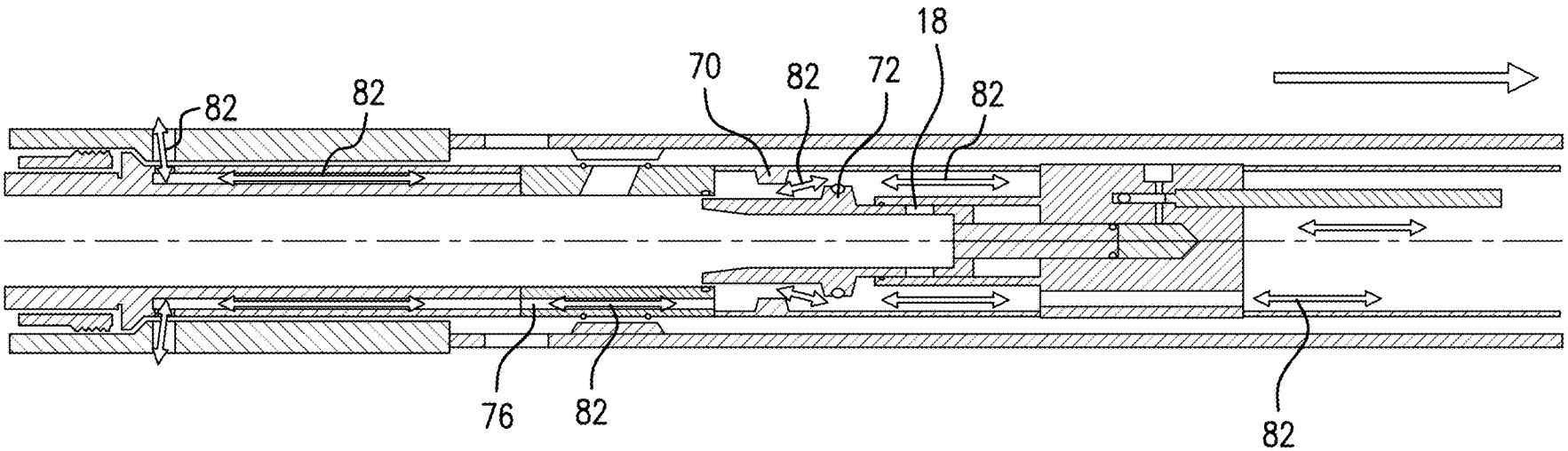
FIG. 11 is the embodiment of FIG. 10 in a second position
Figure 11A:
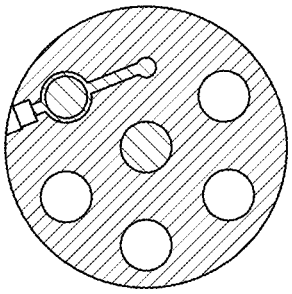
FIGS. 11A-11C are similar views to FIG. 10A-10C with the respective changes in position illustrated.
Figure 11B:
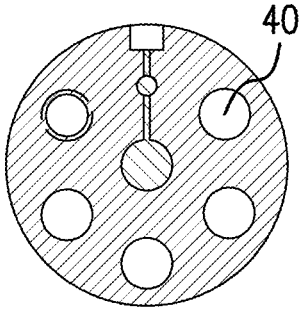
Figure 11C:
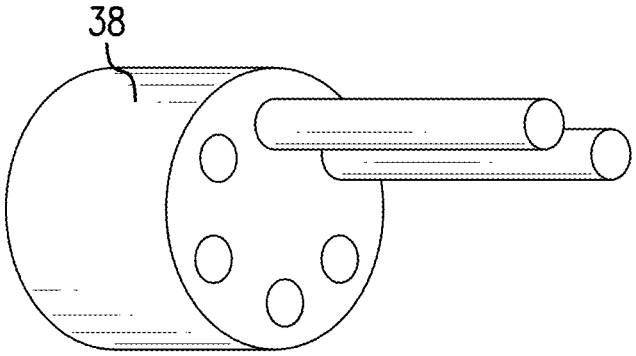
Figure 11D:
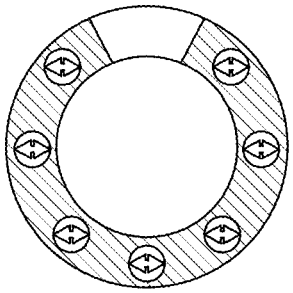
FIG. 11D is a cross section view similar to FIG. 10D but with flow through openings therein.

In yet another embodiment of tool 10, referring to FIG. 10, a backflow prevention configuration is illustrated. Overall, the embodiment is similar to the others described above such that only the backflow prevention configuration need be addressed. The configuration comprises a backflow prevention ring 70 that extends from the sleeve 26. Interactive with the ring 70 is a backflow ring engager 72 that extends from the sleeve 32. These when aligned, and in some embodiments with a seal such as an o-ring 74 prevent fluid flow through body holes 76 (the holes 76 do not fluidically intersect the cross over port) through sleeve 26, through sleeve port 78 and element port 80 to the outside of the housing 20. In this same position the washdown port 18 is open (see FIG. 10). Flow is enabled in this pathway when engager 72 is misaligned with ring 70 as shown in FIG. 11. Flow arrows 82 illustrate the flow path. It will be appreciated that in this latter position, the washport 18 is closed (see FIG. 11).

Figure 12:
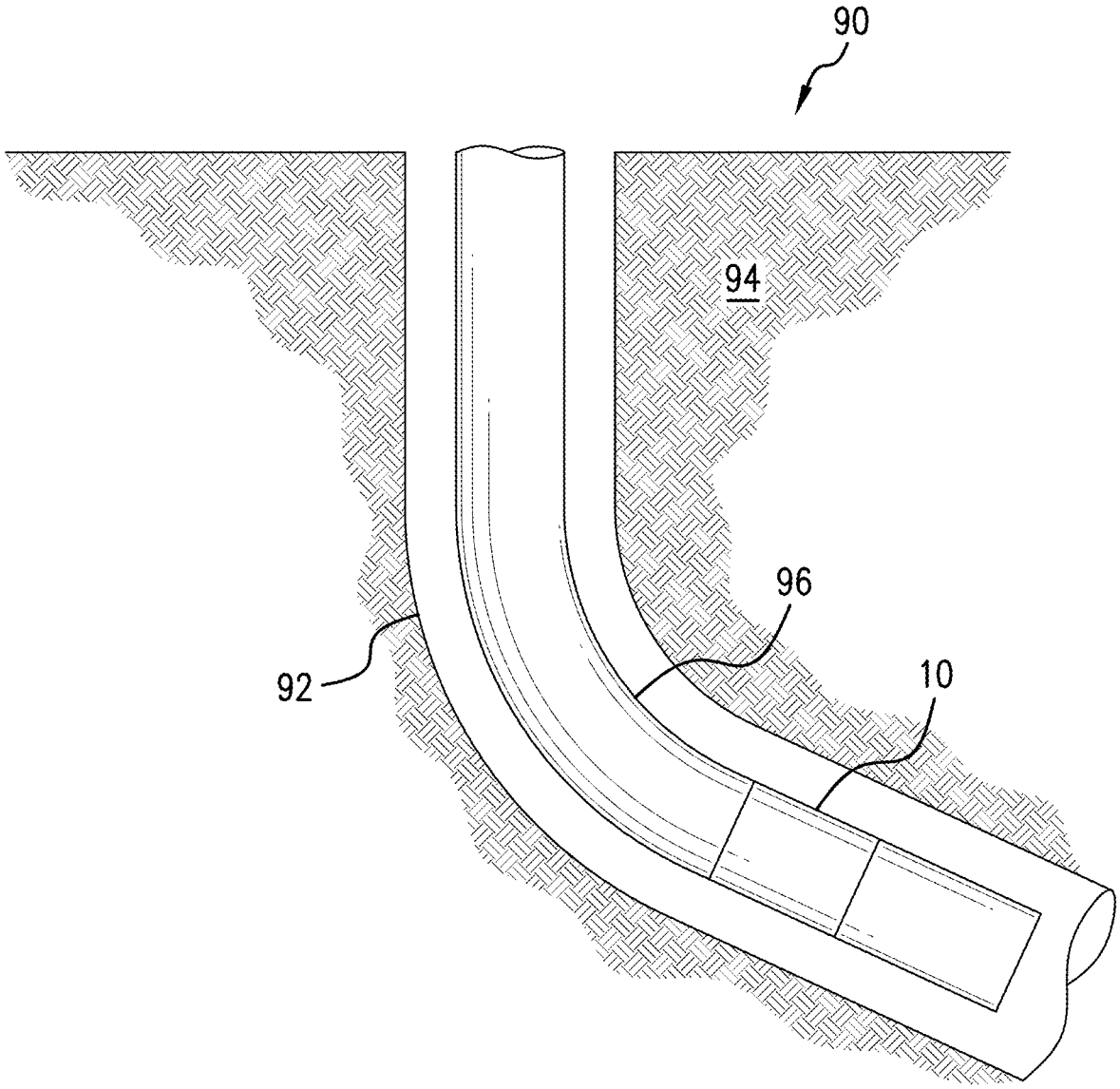
FIG. 12 is a view of a borehole system including a tool as disclosed herein as disclosed herein.

Referring to FIG. 12, a borehole system 90 is illustrated. The system 90 comprises a borehole 92 in a subsurface formation 94. A string 96 is disposed within the borehole 92. And the tool 10 is disposed within or as a part of the string 96 disclosed herein.

Set forth below are some embodiments of the foregoing disclosure:

Embodiment 1: A downhole tool including a gravel pack assembly, a remotely addressable actuator connected to the gravel pack assembly, and a valve responsive to the actuator, the valve opening and closing a washdown path through the tool.

Embodiment 2: The tool as in any prior embodiment, wherein the gravel pack assembly includes a housing having an extension port, a packer disposed on the housing, and a sleeve disposed in the housing, the sleeve including a crossover port that is alignable and misalignable with the extension port pursuant to movement of the sleeve.

Embodiment 3: The tool as in any prior embodiment, wherein the housing includes a seal bore within which the crossover port is disposable to seal fluid flow through the cross over port.

Embodiment 4: The tool as in any prior embodiment, wherein the sleeve includes a backflow prevention ring.

Embodiment 5: The tool as in any prior embodiment, wherein the actuator is addressable electrically.

Embodiment 6: The tool as in any prior embodiment, wherein the actuator includes a pressure chamber that upon a signal received by the actuator causes fluid to change position.

Embodiment 7: The tool as in any prior embodiment, wherein the chamber is an atmospheric chamber.

Embodiment 8: The tool as in any prior embodiment, wherein actuator is an electromotive configuration.

Embodiment 9: The tool as in any prior embodiment, wherein the configuration is a lead screw.

Embodiment 10: The tool as in any prior embodiment, wherein the valve comprises a valve sleeve having a washport.

Embodiment 11: The tool as in any prior embodiment, wherein the valve sleeve further includes a crossover port cover.

Embodiment 12: The tool as in any prior embodiment, wherein the valve sleeve further includes a backflow prevention ring engager.

Embodiment 13: A method for gravel packing a borehole including running a tool as in any prior embodiment to a target depth in the borehole, flowing washdown fluid through the tool, sending an electric signal to the actuator to close the valve, and flowing through a cross over port of the gravel pack assembly.

Embodiment 14: The method as in any prior embodiment further including shifting the sleeve to align the cross over port with an extension port of the gravel pack assembly.

Embodiment 15: The method as in any prior embodiment wherein the shifting further includes moving the cross over port out of a seal bore in a housing of the gravel pack assembly.

Embodiment 16: The method as in any prior embodiment further including shifting the sleeve to close a port.

Embodiment 17: The method as in any prior embodiment, further including disengaging the valve sleeve from a backflow prevention ring.

Embodiment 18: A borehole system including a borehole in a subsurface formation, a tool as in any prior embodiment disposed within the borehole.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tool comprising:

a gravel pack assembly having a housing and including a sleeve movable relative to the housing, the sleeve having a cross over port body, the cross over port body defining a cross over port extending from an inside dimension of the sleeve to an outside dimension of the sleeve, the sleeve including an axially extending flow through body hole that does not fluidically intersect the cross over port;

a remotely addressable actuator connected to the gravel pack assembly;

a valve responsive to the actuator, the valve opening and closing a washdown path through the tool, the valve comprising a valve sleeve movable relative to the cross over port body, the valve sleeve defining a washport radially through the sleeve; and a backflow prevention configuration disposed in the tool, the backflow prevention configuration being closed to prevent flow through the body hole when the washdown path is open.

2. The tool as claimed in claim 1, wherein the gravel pack assembly comprises:

the housing having an extension port;

a packer disposed on the housing; and the crossover port that is alignable and misalignable with the extension port pursuant to movement of the sleeve.

3. The tool as claimed in claim 2, wherein the housing includes a seal bore within which the crossover port is disposable to seal fluid flow through the cross over port.

4. The tool as claimed in claim 2, wherein the sleeve includes a backflow prevention ring.

5. The tool as claimed in claim 1, wherein the actuator is addressable electrically.

6. The tool as claimed in claim 1, wherein the actuator includes a pressure chamber that upon a signal received by the actuator causes fluid to change position.

7. The tool as claimed in claim 6, wherein the chamber is an atmospheric chamber.

8. The tool as claimed in claim 1, wherein actuator is an electromotive configuration.

9. The tool as claimed in claim 8, wherein the configuration is a lead screw.

10. The tool as claimed in claim 1, wherein the valve sleeve further includes a valve sleeve extension.

11. The tool as claimed in claim 1, wherein the valve sleeve further includes a backflow prevention ring engager that makes up a portion of the backflow prevention configuration.

12. A method for gravel packing a borehole comprising:

running a tool as claimed in claim 2 to a target depth in the borehole;

flowing washdown fluid through the tool;

sending an electric signal to the actuator to close the valve; and flowing through a cross over port of the gravel pack assembly.

13. The method as claimed in claim 12 further including shifting the sleeve to align the cross over port with an extension port of the gravel pack assembly.

14. The method as claimed in claim 13 wherein the shifting further includes moving the cross over port out of a seal bore in the housing of the gravel pack assembly.

15. The method as claimed in claim 12 further including shifting the sleeve to close a port.

16. The method as claimed in claim 15, further including disengaging the valve sleeve from a backflow prevention ring.

17. A borehole system comprising:

a borehole in a subsurface formation;

a tool as claimed in claim 1 disposed within the borehole.

18. A downhole tool comprising:

a gravel pack assembly having a housing and including a sleeve movable relative to the housing, the sleeve having a cross over port body, the cross over port body defining a cross over port extending from an inside dimension of the sleeve to an outside dimension of the sleeve, the sleeve including an axially extending flow through body hole that does not fluidically intersect the cross over port;

a remotely addressable actuator connected to the gravel pack assembly;

a valve responsive to the actuator, the valve opening and closing a washdown path through the tool, the valve including a valve sleeve and a sleeve extension, the sleeve extension configured to cover a crossover port of the tool.

* * * * *